US005090199A

United States Patent [19]

Ikuta et al.

[11] Patent Number: 5,090,199

[45] Date of Patent: Feb. 25, 1992

[54] APPARATUS FOR CONTROLLING AIR-FUEL RATIO FOR ENGINE

[75] Inventors: Kenji Ikuta, Hekinan; Toshio Kondo; Hiroshi Haraguchi, both of Kariya, all of Japan

[73] Assignee: Nippondenso Co., Ltd., Kariya, Japan

[21] Appl. No.: 626,829

[22] Filed: Dec. 13, 1990

[30] Foreign Application Priority Data

Dec. 14, 1989 [JP] Japan ..... 1-324291

[51] Int. Cl.[5] ..... F01N 3/20

[52] U.S. Cl. ..... 60/276; 60/277; 60/285

[58] Field of Search ..... 60/274, 276, 277, 285

[56] References Cited

U.S. PATENT DOCUMENTS 4,027,477 6/1977 Storey ..... 60/276

FOREIGN PATENT DOCUMENTS 56-64125 6/1981 Japan .
60-3446 1/1985 Japan .
243316 12/1985 Japan ..... 60/276
61-83466 4/1986 Japan .
45913 2/1989 Japan ..... 60/276
64-53038 3/1989 Japan .
1-110853 4/1989 Japan .

*Primary Examiner*—Douglas Hart
*Attorney, Agent, or Firm*—Cushman, Darby & Cushman

[57] ABSTRACT

An air-fuel ratio control apparatus for an engine for controlling a fuel injection amount so that an air-fuel ratio of a mixture gas which is supplied to the engine is set to a stoichiometric air-fuel ratio is disclosed. The apparatus has a first oxygen concentration sensor on the upstream side of a catalyst arranged in an exhaust pipe of the engine and a second oxygen concentration sensor on the downstream side, respectively. The first sensor gives to the apparatus a first linear detection signal for the air-fuel ratio of the mixture gas. The second sensor gives to the apparatus a second detection signal indicating whether the air-fuel ratio of the mixture gas is rich or lean for the stoichiometric air-fuel ratio. A target air-fuel ratio is set in accordance with the second detection signal and the first detection signal and the target air-fuel ratio are compared, thereby controlling a fuel injection amount. Thus, a deviation between the actual air-fuel ratio and the first detection signal can be accurately corrected and the air-fuel ratio can be accurately controlled to a value in a region where a high purification factor of the catalyst is derived.

12 Claims, 9 Drawing Sheets

APPARATUS FOR CONTROLLING AIR-FUEL RATIO FOR ENGINE

BACKGROUND OF THE INVENTION

1. Field of the Invention

The present invention relates to an air-fuel ratio control apparatus for an engine for controlling a fuel injection amount so that an air-fuel ratio of a mixture gas which is supplied to the engine is set to a stoichiometric air-fuel ratio.

2. Description of the Related Background Art

Hitherto, there has been disclosed an air-fuel ratio control apparatus for an engine in which a first oxygen concentration sensor (hereinafter referred to an air-fuel ratio sensor) which can obtain a detection signal which is linear to an air-fuel ratio of a mixture gas which is supplied to the engine is provided on the upstream side of a 3-component catalytic converter arranged in an exhaust pipe and a fuel injection amount is controlled so that an air-fuel ratio is set to a stoichiometric air-fuel ratio in accordance with the detection signal from the air-fuel ratio sensor, wherein a second oxygen concentration sensor (referred to an $O_2$ sensor) which can obtain a rich/lean detection signal for the air-fuel ratio of the mixture gas which is supplied to the engine is provided side by side with the air-fuel ratio sensor on the upstream side of the 3-component catalytic converter, and a deviation between an actual air-fuel ratio and the detection signal of the air-fuel ratio sensor is corrected on the basis of the detection signal from the $O_2$ sensor (for instance, refer to JP-A-56-64125).

However, in the case where the $O_2$ sensor is provided on the upstream side of the 3-component catalytic converter and a deviation between the actual air-fuel ratio and the detection signal of the air-fuel ratio sensor is corrected by the detection signal of the $O_2$ sensor as in the above conventional apparatus, there are the following problems.

(1) To raise a purification factor of the 3-component catalytic converter, the air-fuel ratio is controlled in a manner such that the rich and lean air-fuel ratios are repeated at a short period with respect to the stoichiometric air-fuel ratio as a center value. In the case where the $O_2$ sensor is provided on the upstream side of the 3-component catalytic converter, the detection signal of the $O_2$ sensor changes so that the rich (R) and lean (L) values are repeated at a short period as shown in (a) in FIG. 3. Therefore, if the air-fuel ratio is corrected on the basis of the detection signal of such a short period, since the air-fuel ratio is influenced by a fluctuation of the detection signal, the air-fuel ratio cannot be stably controlled.

(2) In the upstream of the 3-component catalytic converter, the exhaust gas is not sufficiently mixed. Therefore, the detection signal of the $O_2$ sensor is easily influenced by a certain special cylinder in dependence on the attaching position or the like.

(3) A temperature is high in the upstream of the 3-component catalytic converter. A copper component is included in the exhaust gas. Therefore, the $O_2$ sensor itself for correction remarkably deteriorates.

SUMMARY OF THE INVENTION

The present invention is made to solve the foregoing problems and it is an object of the invention to provide an air-fuel ratio control apparatus for an engine which properly corrects a deviation between an actual air-fuel ratio and a detection signal of an air-fuel ratio sensor and accurately controls the air-fuel ratio to a stoichiometric air-fuel ratio.

As shown in FIG. 1, according to the invention, there is provided an air-fuel ratio control apparatus for an engine (10), comprising:

a catalyst (38), arranged in an exhaust pipe of the engine, for purifying an exhaust gas;

a first oxygen concentration sensor (36), arranged on the upstream side of the catalyst, for outputting a first detection signal which is linear to an air-fuel ratio of a mixture gas which is supplied to the engine;

a second oxygen concentration sensor (37), arranged on the downstream side of the catalyst, for outputting a second detection signal indicative that the air-fuel ratio of the mixture gas which is supplied to the engine is rich or lean as compared with a stoichiometric air-fuel ratio;

target air-fuel ratio setting means (40) for setting a target air-fuel ratio in accordance with the second detection signal; and fuel injection amount setting means (45) for setting a fuel injection amount which is supplied to the engine in accordance with the first detection signal and the target air-fuel ratio.

It is desirable that the target air-fuel ratio setting means has first target air-fuel ratio setting means for setting the target air-fuel ratio to a value on the lean side so as to be gradually reduced by every predetermined value per unit time in the case where the second detection signal indicates a rich state and for setting the target air-fuel ratio to a value on the rich side so as to be gradually increased by every predetermined value per unit time in the case where the second detection signal indicates a lean state.

The target air-fuel ratio setting means can also have:

first time detecting means for detecting a total time of times corresponding to the rich state in a predetermined period of time of the second detection signal;

second time detecting means for detecting a total time of times corresponding to the lean state in the predetermined period of time of the second detection signal; and second target air-fuel ratio setting means for setting the target air-fuel ratio to a value on the lean side so as to be gradually reduced by a predetermined value at a time in the case where the total time of the times of the rich state is longer than the total time of the times of the lean state and for setting the target air-fuel ratio to a value on the rich side so as to be gradually increased by a predetermined value at a time in the case where the total time of the times of the lean state is longer than the total time of the times of the rich state.

Further, it is preferable that the fuel injection amount setting means periodically changes the target air-fuel ratio at a predetermined amplitude for a target air-fuel ratio which is set by the target air-fuel ratio setting means.

From the above construction, the target air-fuel ratio is set by the target air-fuel ratio setting means in accordance with the second detection signal which is output from the second oxygen concentration sensor. Then, the fuel injection amount is set by the fuel injection amount setting means in accordance with the first detection signal which is output from the first oxygen concentration sensor and the target air-fuel ratio.

DESCRIPTION OF THE PREFERRED EMBODIMENTS

Figure 1:
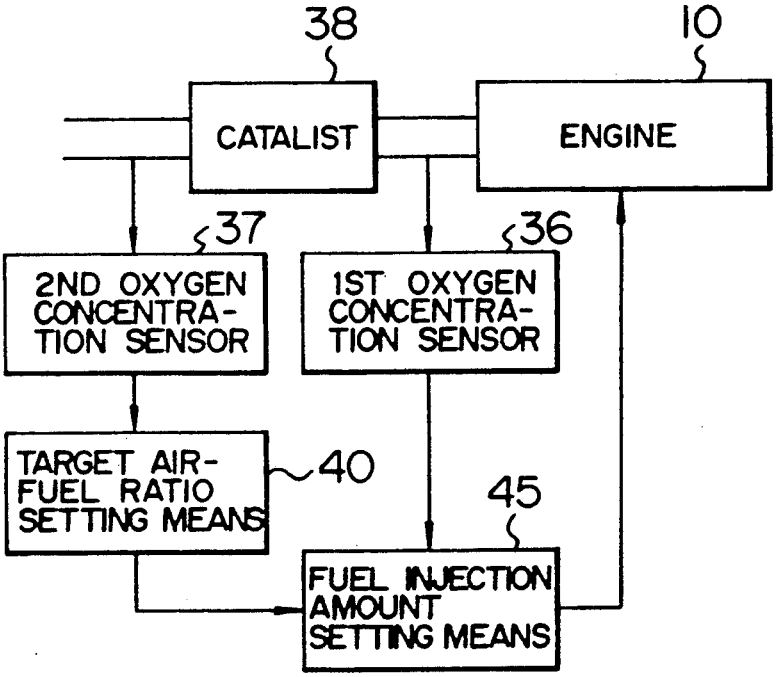
FIG. 1 is a diagram corresponding to Claims of the present invention.
Figure 2:
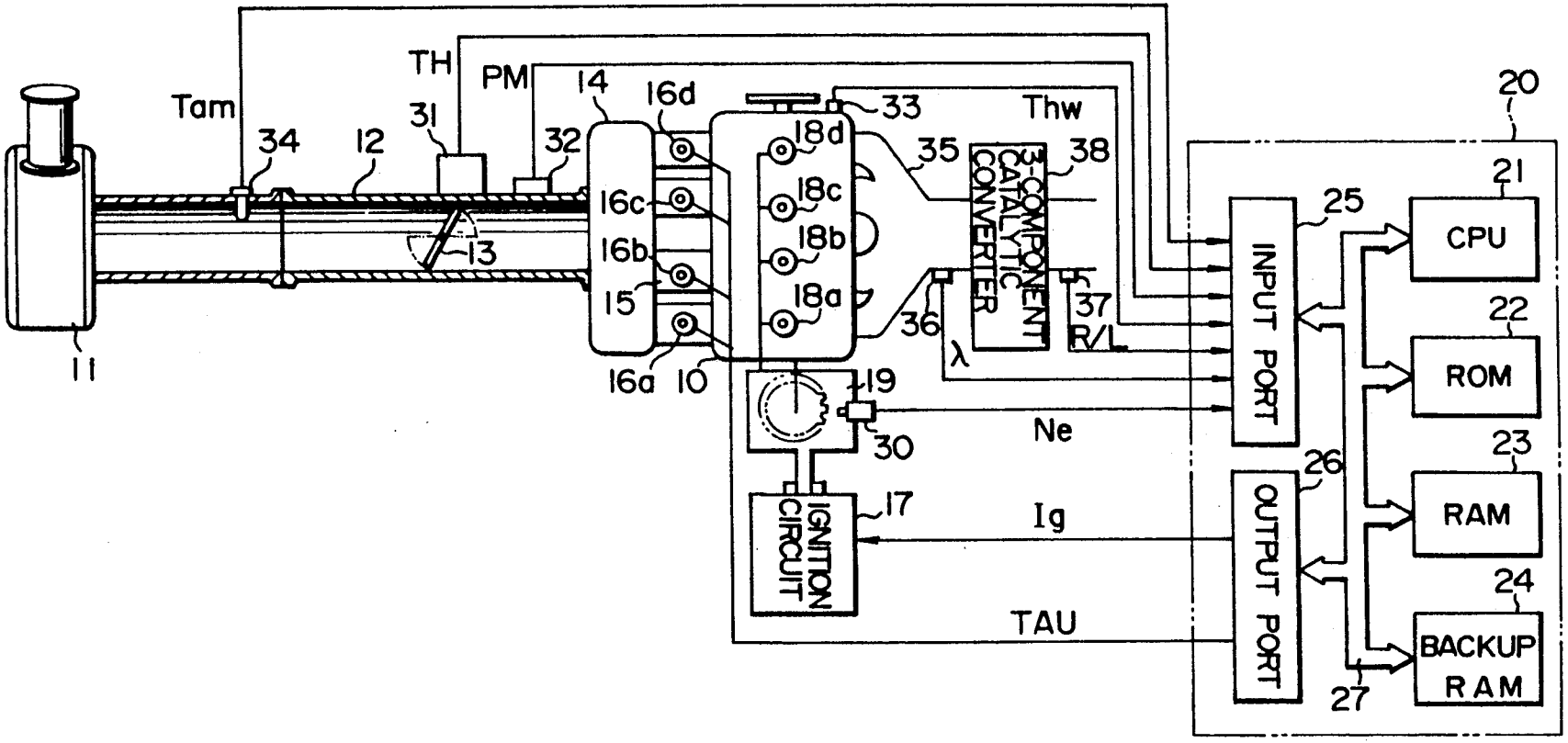
FIG. 2 is a constructional diagram of an embodiment of the invention.

To further clarify a construction of the invention described above, an air-fuel ratio control apparatus for an engine as a preferred embodiment of the invention will be described hereinbelow. FIG. 2 is a schematic constructional diagram showing an engine 10 whose air-fuel ratio is controlled and its peripheral apparatuses. As shown in the diagram, in the embodiment, an ignition timing $I_g$ of an engine 10 and a fuel injection amount TAU are controlled by an electronic control unit (ECU) 20.

As shown in FIG. 2, the engine 10 is of a spark ignition type of four cylinders and four cycles. An intake air is sucked into each cylinder from the upstream through an air cleaner 11, an intake pipe 12, a throttle valve 13, a surge tank 14, and an intake branch pipe 15. On the other hand, a fuel is fed with a pressure from a fuel tank (not shown) and is injected and supplied from fuel injection valves 16*a*, 16*b*, 16*c*, and 16*d* provided for the intake branch pipe 15. On the other hand, the engine 10 has: a distributor 19 for distributing an electric signal of a high voltage which is supplied from an ignition circuit 17 to spark plugs 18*a*, 18*b*, 18*c*, and 18*d* of the cylinders; a rotational speed sensor 30, provided in the distributor 19, for detecting a rotational speed $N_e$ of the engine 10; a throttle sensor 31 for detecting an opening degree TH of the throttle valve 13; an intake pressure sensor 32 for detecting an intake pressure PM on the downstream side of the throttle valve 13; a warming-up sensor 33 for detecting a temperature $T_{hw}$ of cooling water of the engine 10; and an intake temperature sensor 34 for detecting a temperature $T_{am}$ of intake air. The rotational speed sensor 30 is provided so as to face a ring gear which rotates synchronously with a crank shaft of the engine 10. The sensor 30 outputs 24 pulse signals per rotation, that is, 720° CA of the engine 10 in proportion to the rotational speed $N_e$. The throttle sensor 31 outputs not only an analog signal corresponding to the throttle opening degree TH but also an on/off signal from an idle switch to detect that the throttle valve 13 is almost fully closed.

Further, an exhaust pipe 35 of the engine 10 has therein a 3-component catalytic converter 38 to reduce harmful components (CO, HC, NOx, and the like) contained in the exhaust gas which is exhausted from the engine 10. In addition, an air-fuel ratio sensor 36 as a first oxygen concentration sensor for outputting a linear detection signal according to an air-fuel ratio λ of the mixture gas supplied to the engine 10 is provided on the upstream side of the 3-component catalytic converter 38. An $O_2$ sensor 37 as a second oxygen concentration sensor for outputting a detection signal indicating whether the air-fuel ratio λ of the mixture gas supplied to the engine 10 is rich or lean as compared with a stoichiometric air-fuel ratio $\lambda_0$ is provided on the downstream side of the 3-component catalytic converter 38.

The ECU 20 is constructed as an arithmetic logic operation circuit mainly comprising well-know components such as CPU 21, ROM 22, RAM 23, backup RAM 24, and the like. The ECU 20 is mutually connected through a bus 27 to an input port 25 for inputting detection signals from the sensors, an output port 26 to output control signals to actuators, and the like. The ECU 20 receives through the input port 25 the signals indicative of the intake pressure PM, intake temperature $T_{am}$, throttle opening degree TH, cooling water temperature $T_{hw}$, air-fuel ratio λ, rotational speed $N_e$, and the like. Then, the ECU 20 calculates the fuel injection amount TAU and the ignition timing $I_g$ on the basis of those information and outputs control signals to the fuel injection valves 16*a* to 16*d* and the ignition circuit 17 through the output port 26. Among the above controls, the air-fuel ratio control will now be described hereinbelow.

The ECU 20 has previously been designed by the following method in order to execute the air-fuel ratio control. The designing method, which will be explained hereinbelow, is disclosed in JP-A-64-110853.

(1) Modeling of an object to be controlled

In the embodiment, as a model of a system to control the air-fuel ratio λ of the engine 10, an autoregressive moving average model of degree 1 having a vain time P=3 is used and is, further, approximated in consideration of a disturbance d.

First, the model of the system for controlling the air-fuel ratio λ using the autoregressive moving average model can be approximated by $$\lambda(k)=a\cdot\lambda(k-1)+b\cdot FAF(k-3) \tag{1}$$

where,

λ: air-fuel ratio

FAF: air-fuel ratio correction coefficient a, b: constants k: variable indicative of the number of control times from the start of the first sampling Further, when considering the disturbance d, the model of the control system can be approximated by $$\begin{aligned}\lambda(k) &= a\cdot\lambda(k-1)\\ &\quad + b\cdot FAF(k-3)\\ &\quad + d(k-1)\end{aligned} \tag{2}$$

For the models which were approximated as mentioned above, it is easily possible to obtain the constants a and b by a discretion by the rotational synchronous (360° CA) sampling using a step response, that is, to obtain a transfer function G of the system to control the air-fuel ratio λ.

(2) Display method of a state variable amount X

By rewriting the above equation (2) by using the state variable amount $X(k)=[X_1(k), X_2(k), X_3(k), X_4(k)]^T$, following equation (3) is obtained.

$$\begin{pmatrix} X_1(k+1) \\ X_2(k+1) \\ X_3(k+1) \\ X_4(k+1) \end{pmatrix} = \begin{pmatrix} a & b & 0 & 0 \\ 0 & 0 & 1 & 0 \\ 0 & 0 & 0 & 1 \\ 0 & 0 & 0 & 0 \end{pmatrix} \begin{pmatrix} X_1(k) \\ X_2(k) \\ X_3(k) \\ X_4(k) \end{pmatrix} + \begin{pmatrix} 0 \\ 0 \\ 0 \\ 1 \end{pmatrix} FAF(k) + \begin{pmatrix} 1 \\ 0 \\ 0 \\ 0 \end{pmatrix} d(k) \quad (3)$$

Then, we have $$\left.\begin{aligned} X_1(k+1) &= aX_1(k) + bX_2(k) \\ &\quad + d(k) = \lambda(k+1) \\ X_2(k+1) &= FAF(k-2) \\ X_3(k+1) &= FAF(k-1) \\ X_4(k+1) &= FAF(k) \end{aligned}\right\} \quad (4)$$

(3) Designing of a regulator

A regulator is designed with respect to the above equations (5) and (6). An optimum feedback gain $K=[K_1, K_2, K_3, K_4]$ and the state variable amount $X^T(k)=[\lambda(k), FAF(k-3), FAF(k-2), FAF(k-1)]$ are used, so that $$\begin{aligned} FAF(k) &= k \cdot X^T(k) \\ &= K_1 \cdot \lambda(k) + K_2 \cdot FAF(k-3) \\ &\quad + K_3 \cdot FAF(k-2) \\ &\quad + K_4 \cdot FAF(k-1) \end{aligned} \quad (5)$$

is obtained. Further, an integration term $Z_I(k)$ to absorb errors is added.

$$\begin{aligned} FAF(k) &= K_1 \cdot \lambda(k) \\ &\quad + K_2 \cdot FAF(k-3) \\ &\quad + K_3 \cdot FAF(k-2) \\ &\quad + K_4 \cdot FAF(k-1) + Z_1(k) \end{aligned} \quad (6)$$

Due to this, the air-fuel ratio $\lambda$ and the correction coefficient FAF can be obtained.

The integration term $Z_I(k)$ is a value which is determined by a deviation between a target air-fuel ratio $\lambda_{TG}$ and an actual air-fuel ratio $\lambda(k)$ and by an integration constant $K_a$ and is obtained by the following equation (7).

$$Z_I(k) = Z_I(k-1) + Ka \cdot (\lambda_{TG} - \lambda(k)) \quad (7)$$

Figure 4:
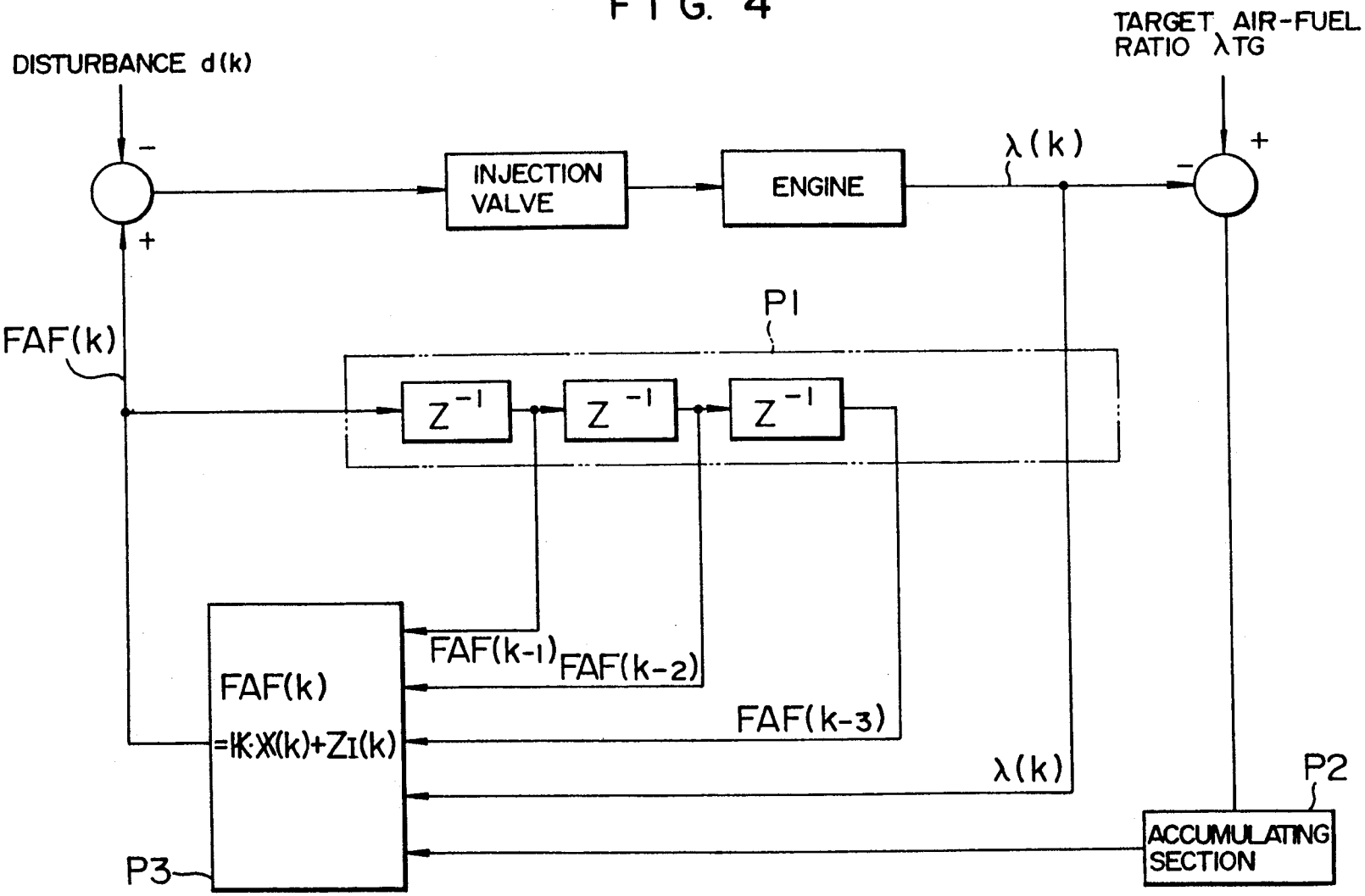
FIG. 4 is a block diagram for explaining the operation of an air-fuel control in the embodiment.

FIG. 4 is a block diagram of a system to control the air-fuel ratio $\lambda$ by which the model was designed as mentioned above. In FIG. 4, the $Z^{-1}$ transformation has been used to derive the air-fuel ratio correction coefficient FAF(k) from FAF(k−1) and the FAF(k) has been displayed. For this purpose, the past air-fuel ratio correction coefficient FAF(k−1) is stored into the RAM 23 and is read out at the next control timing and is used.

On the other hand, a block $P_1$ surrounded by an alternate long and short dash line in FIG. 4 corresponds to a portion to decide the state variable amount X(k) in a state in which the air-fuel ratio $\lambda(k)$ is feedback controlled to the target air-fuel ratio $\lambda_{TG}$. A block $P_2$ corresponds to a portion (accumulating portion) to obtain the integration term $Z_I(k)$. A block $P_3$ corresponds to a portion to calculate the present air-fuel ratio correction coefficient FAF(k) from the state variable amount X(k) which was determined in the block $P_1$ and the integration term $Z_I(k)$ which was obtained in the block $P_2$.

(4) Determination of the optimum feedback gain K and the integration constant $K_a$ For instance, the optimum feedback gain K and the integration constant $K_a$ can be set by minimizing an evaluation function J which is shown by the following equation.

$$J = \sum_{k=0}^{\infty} \{Q(\lambda(k) - \lambda_{TG})^2 + R(FAF(k) - FAF(k-1))^2\} \quad (8)$$

The evaluation function J intends to minimize the deviation between the actual air-fuel ratio $\lambda(k)$ and the target air-fuel ratio $\lambda_{TG}$ while restricting the motion of the air-fuel ratio correction coefficient FAF(k). A weighting of the restriction to the air-fuel ratio correction coefficient FAF(k) can be changed by the values of weight parameters Q and R. Therefore, it is sufficient to determine the optimum feedback gain K and the integration constant $K_a$ by repeating simulations until the optimum control characteristics are obtained by variably changing the values of the weight parameters Q and R.

Further, the optimum feedback gain K and the integration constant $K_a$ depend on the model constants a and b. Therefore, to assure the stability (robust performance) of the system for a fluctuation (parameter fluctuation) of the system to control the actual air-fuel ratio $\lambda$ it is necessary to design the optimum feedback gain K and the integration constant $K_a$ in consideration of fluctuation amounts of the model constants a and b. Accordingly, the simulations are executed in consideration of the fluctuations of the model constants a and b which can be actually caused, thereby deciding the optimum feedback gain K and the integration constant $K_a$ which satisfy the stability.

Although (1) the modeling of an object to be controlled, (2) the display method of the state variable amount, (3) the designing of the regulator, and (4) the determination of the optimum feedback gain and the integration constant have been described above, they are predetermined. The ECU 20 executes the control by using the results of them, that is, only the equations (6) and (7).

Figure 7:
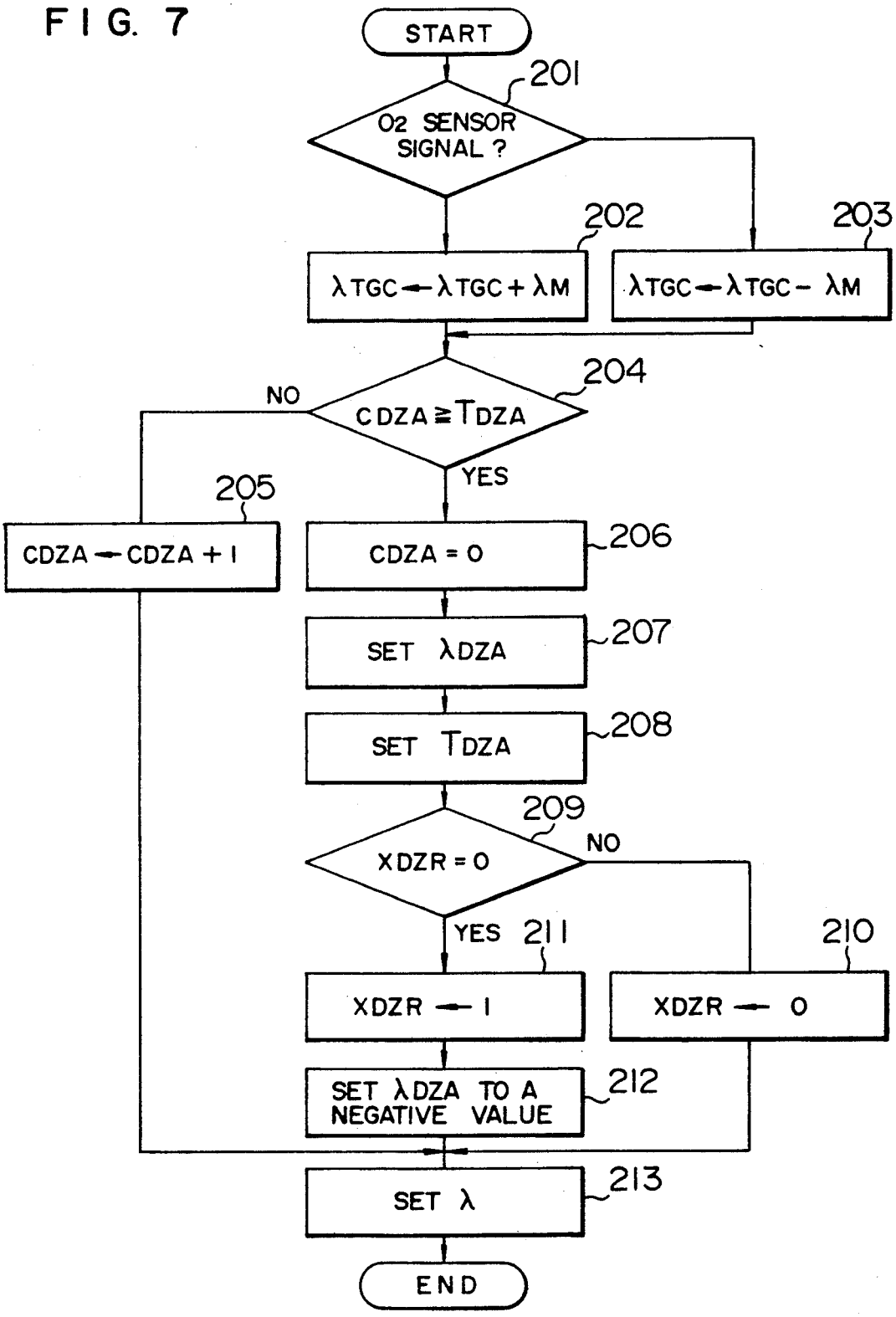
Figure 8:
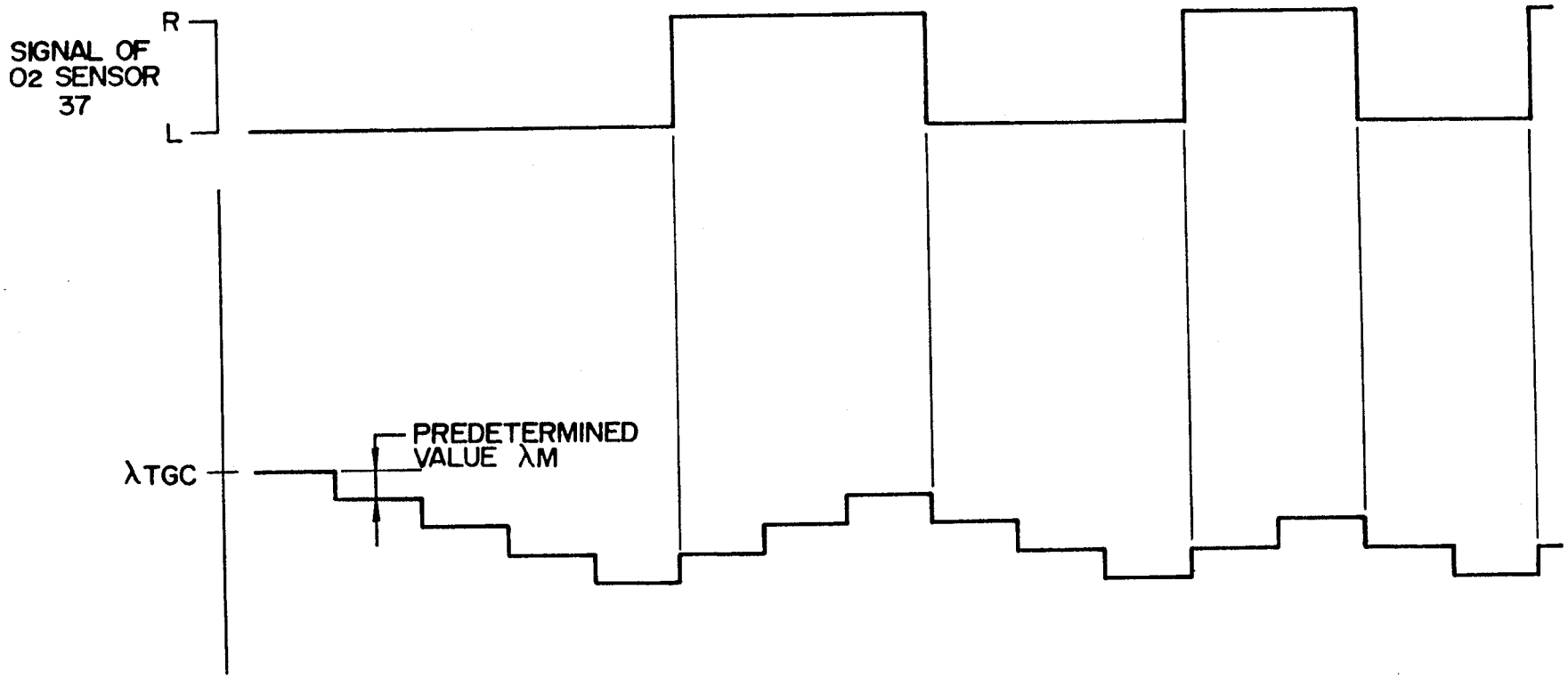
FIGS. 8 and 9 are timing charts of the embodiment.

The air-fuel ratio control will now be described hereinbelow with reference to flowcharts shown in FIGS. 5 and 7.

Figure 5:
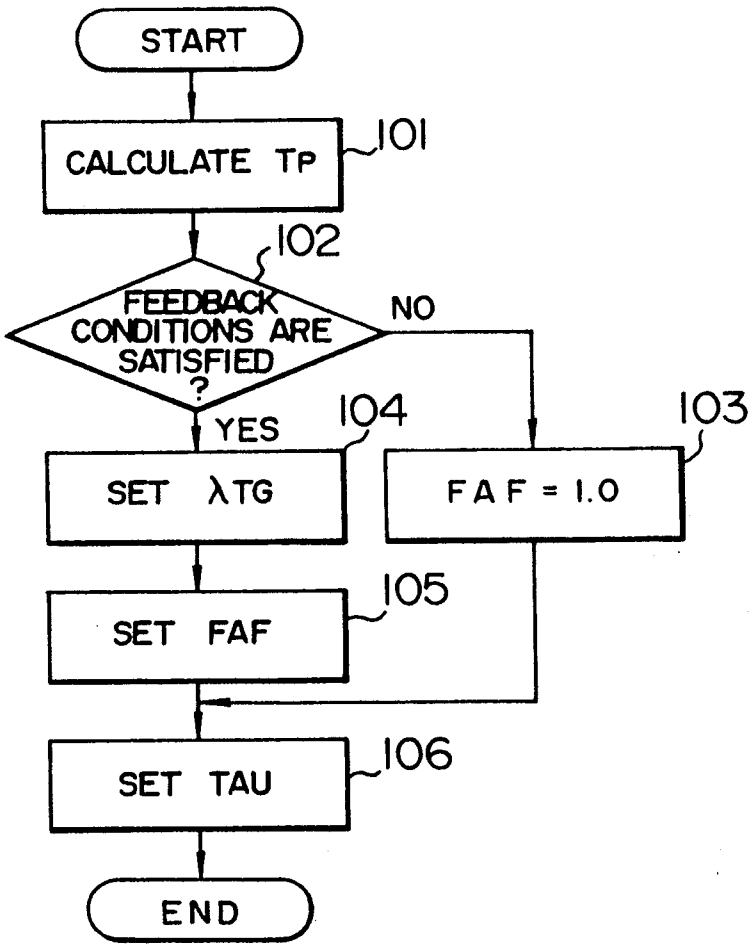
FIGS. 5 and 7 are block diagrams for explaining the operation of the embodiment.

FIG. 5 shows a process to set the fuel injection amount TAU which is executed synchronously with the rotation (every 360° CA).

First, in step 101, a fundamental fuel injection amount $T_p$ is calculated on the basis of the intake pressure PM, rotational speed $N_e$, and the like. In step 102, a check is made to see if the feedback conditions of the air-fuel ratio $\lambda$ are satisfied or not. The feedback conditions are such that the cooling water temperature $T_{hw}$ is equal to or higher than a predetermined value and a load and a rotational speed are not high as is well known. If the feedback conditions of the air-fuel ratio $\lambda$ are not satisfied in step 102, the air-fuel ratio correction coefficient FAF is set to 1 in step 103. Then, step 106 follows.

On the other hand, if the feedback conditions of the air-fuel ratio $\lambda$ are satisfied in step 102, the target air-fuel ratio $\lambda_{TG}$ is set in step 104 (which will be explained in detail hereinlater). In step 105, the air-fuel ratio correction coefficient FAF is set so that the air-fuel ratio $\lambda$ is equal to the target air-fuel ratio $\lambda_{TG}$. In detail, the air-fuel ratio correction coefficient FAF is calculated by the equations (6) and (7) in accordance with the target air-fuel ratio $\lambda_{TG}$ and the air-fuel ratio $\lambda(k)$ which is detected by the air-fuel ratio sensor 36.

In step 106, a fuel injection amount is corrected for the fundamental fuel injection amount $T_p$ by the following equation in accordance with the air-fuel ratio correction coefficient FAF and another correction coefficient FALL, so that the fuel injection amount TAU is set.

$$TAU = FAF \times T_p \times FALL$$

An operation signal according to the fuel injection amount TAU which was set as mentioned above is output to the fuel injection valves 16*a* to 16*d*.

The setting of the target air-fuel ratio $\lambda_{TG}$ (step 104 in FIG. 5) will now be described.

Figure 6:
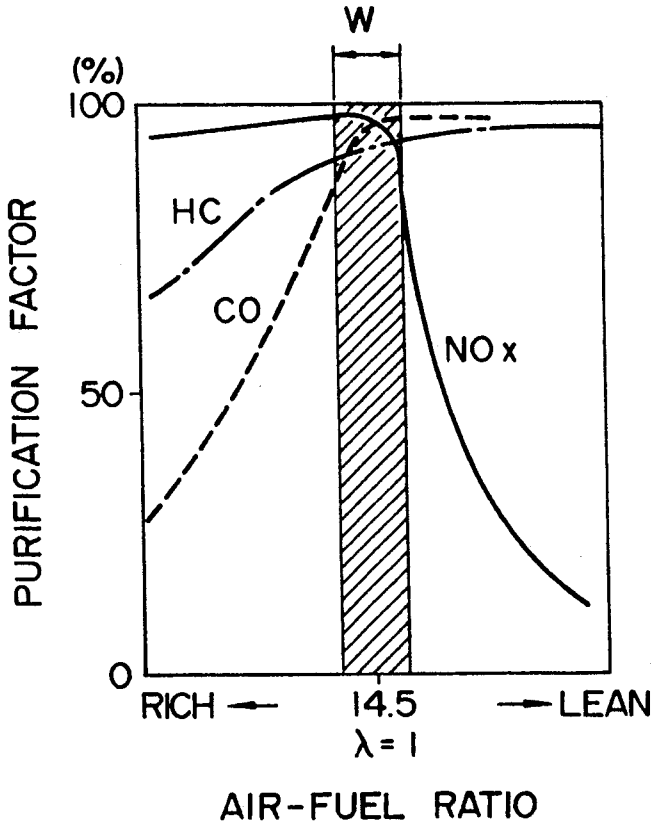
FIG. 6 is a characteristic diagram of a purification factor of a 3-component catalytic converter.

First, a center value $\lambda_{TGC}$ of the target air-fuel ratio is set on the basis of the detection signal of the $O_2$ sensor 37 so as to correct a deviation between the actual air-fuel ratio and the detection signal of the air-fuel ratio sensor 36. In detail, when the detection signal of the $O_2$ sensor 37 indicates the rich state, the center value $\lambda_{TGC}$ is set to a value on the lean side by only a predetermined value $\lambda_M$. On the contrary, when the detection signal of the $O_2$ sensor 37 indicates the lean state, the center value $\lambda_{TGC}$ is set to a value on the rich side by only the predetermined value $\lambda_M$. FIG. 6 shows characteristics of a purification factor $\eta$ of the 3-component catalytic converter 38 to the air-fuel ratio $\lambda$. As will be explained hereinlater, the air-fuel ratio is controlled within a range of a catalyst window W (hatched portion in the diagram) shown in FIG. 6. Since the catalyst window W is about 0.1%, the above predetermined value $\lambda_M$ is set to be smaller than the value of W.

On the other hand, the deviation between the actual air-fuel ratio and the detection signal of the air-fuel ratio sensor also differs depending on the rotational speed $N_e$ and the intake pressure PM. That is, the air-fuel ratio at which the maximum purification factor $\eta$ is obtained differs depending on the rotational speed $N_e$ and the intake pressure PM. Therefore, an air-fuel ratio at which the maximum purification factor $\eta$ is obtained is previously derived as an initial value of the center value $\lambda_{TGC}$ by the rotational speed $N_e$ and the intake pressure PM and is stored into the ROM 22. It is sufficient to read out such an air-fuel ratio from the ROM 22 at the start of the feedback control. The initial value of the center value $\lambda_{TGC}$ has characteristics such that it is set to a value on the rich side as the rotational speed $N_e$ and the intake pressure PM increase.

For the center value $\lambda_{TGC}$ which is set as mentioned above, the target air-fuel ratio $\lambda_{TG}$ is changed (dither control) periodically (dither period of $T_{DZA}$) at a predetermined amplitude (dither amplitude) $\lambda_{DZA}$ within a range of the catalyst window W. With respect to the dither amplitude $\lambda_{DZA}$ and the either period $T_{DZA}$ as well, the optimum value at which the maximum purification factor $\eta$ is obtained differs depending on the rotational speed $N_e$ and the intake pressure PM. Therefore, the optimum values of the dither amplitude $\lambda_{DZA}$ and the dither period $T_{DZA}$ are previously obtained on the basis of the rotational speed $N_e$ and the intake pressure PM and stored into the ROM 22. It is sufficient to sequentially read out those optimum values from the ROM 22.

The setting of the target air-fuel ratio $\lambda_{TG}$ will now be described with reference to a flowchart shown in FIG. 7.

In the processes in steps 201 to 203, the center value $\lambda_{TGC}$ of the target air-fuel ratio mentioned above is set. First, in step 201, a check is made to see if the detection signal from the $O_2$ sensor 37 indicates the rich state or the lean state. If the detection signal from the $O_2$ sensor 37 indicates the rich state, the center value $\lambda_{TGC}$ is increased by only the predetermined value $\lambda_M$ in step 202, that is, it is set to a value on the lean side ($\lambda_{TGC} \leftarrow \lambda_{TGC} + \lambda_M$). On the other hand, in step 201, if the detection signal from the $O_2$ sensor 37 indicates the lean state, the center value $\lambda_{TGC}$ is decreased by only the predetermined value $\lambda_M$ in step 203, that is, it is set to a value on the lean side ($\lambda_{TGC} \leftarrow \lambda_{TGC} - \lambda_M$).

The processes in steps 204 to 213 relate to the foregoing dither control. In step 204, a check is made to see if a count value of a counter CDZA is equal to or larger than the dither period $T_{DZA}$ or not. The counter CDZA counts the dither period $T_{DZA}$. If the count value of the counter CDZA is less than the dither period $T_{DZA}$, the counter CDZA is counted up (CDZA←CDZA+1) in step 205. Then, step 213 follows.

On the other hand, if the count value of the counter CDZA is equal to or larger than the dither period $T_{DZA}$ in step 204, processes to change the target air-fuel ratio $\lambda_{TG}$ step by step are executed in steps 206 to 212. First, in step 206, the counter CDZA is reset (CDZA=0). The dither amplitude $\lambda_{DZA}$ is set in step 207. In detail, as mentioned above, as a dither amplitude $\lambda_{DZA}$, the optimum value corresponding to the rotational speed $N_e$ and the intake pressure PM is previously obtained and stored into the ROM 22 as a two-dimensional map of the rotational speed $N_e$ and the intake pressure PM. The dither amplitude $\lambda_{DZA}$ is sequentially read out from the ROM 22. In the next step 208, the dither period $T_{DZA}$ is set. With respect to the dither period $T_{DZA}$ as well, in a manner similar to the dither amplitude $\lambda_{DZA}$, the optimum value is stored into the ROM 22 as a two-dimensional map of the rotational speed $N_e$ and the intake pressure PM. The dither period $T_{DZA}$ is sequentially read out from the ROM 22.

In step 209, a check is made to see if a flag XDZR has been set or not. If the flag XDZR has been set (XDZR=1), this means that the target air-fuel ratio $\lambda_{TG}$ has been set to a value on the rich side for the center value $\lambda_{TGC}$. If it is determined in step 209 that the flag XDZR has been set (XDZR=1), that is, if the target air-fuel ratio $\lambda_{TG}$ has been set to a value on the rich side for the center value $\lambda_{TGC}$ until the preceding control timing, in step 210, the flag XDZR is reset (XDZR←0) so that the target air-fuel ratio $\lambda_{TG}$ is set to a value on the lean side by only the dither amplitude $\lambda_{DZA}$ for the center value $\lambda_{TGC}$. On the other hand, if it is decided in step 209 that the flag XDZR has been reset (XDZR=0), that is, if the target air-fuel ratio $\lambda_{TG}$ has been set to a value on the lean side for the center value $\lambda_{TGC}$ until the preceding control timing, in step 211, the flag XDZR is set (XDZR←1) so that the target air-fuel ratio $\lambda_{TG}$ is set to a value on the rich side by only the dither amplitude $\lambda_{DZA}$ for the center value $\lambda_{TGC}$. In the next step 212, the dither amplitude $\lambda_{DZA}$ is set to a negative value and step 213 follows.

In step 213, the target air-fuel ratio $\lambda_{TG}$ is set by the following equation.

$$\lambda_{TG}=\lambda_{TGC}+\lambda_{DZA}$$

Therefore, in the case where the target air-fuel ratio $\lambda_{TG}$ is set to a value on the lean side by only the dither amplitude $\lambda_{DZA}$ for the center value $\lambda_{TGC}$, the target air-fuel ratio $\lambda_{TG}$ is set by the following equation in step 213.

$$\lambda_{TG}=\lambda_{TGC}+\lambda_{DZA}$$

On the other hand, in the case of setting the target air-fuel ratio $\lambda_{TG}$ to a value on the rich side by only the dither amplitude $\lambda_{DZA}$ for the center value $\lambda_{TGC}$, since the dither amplitude $\lambda_{DZA}$ is set to a negative value in step 212, the target air-fuel ratio $\lambda_{TG}$ is set by the following equation in step 213.

$$\lambda_{TG}=\lambda_{TGC}-\lambda_{DZA}$$

A timing chart in the setting of the center value $\lambda_{TGC}$ mentioned above is shown. For a period of time when the detection signal of the $O_2$ sensor 37 indicates the lean state, the center value $\lambda_{TGC}$ is set to a value on the rich side by the predetermined value $\lambda_M$ at a time. For a period of time when the detection signal of the $O_2$ sensor 37 indicates the rich state, the center value $\lambda_{TGC}$ is set to a value on the lean side by the predetermined value $\lambda_M$ at a time. Therefore, the center value $\lambda_{TGC}$ is set to the stoichiometric air-fuel ratio shown by the air-fuel ratio sensor 36. Thus, the deviation between the actual air-fuel ratio and the detection signal of the air-fuel ratio sensor 36 can be corrected.

Figure 9:
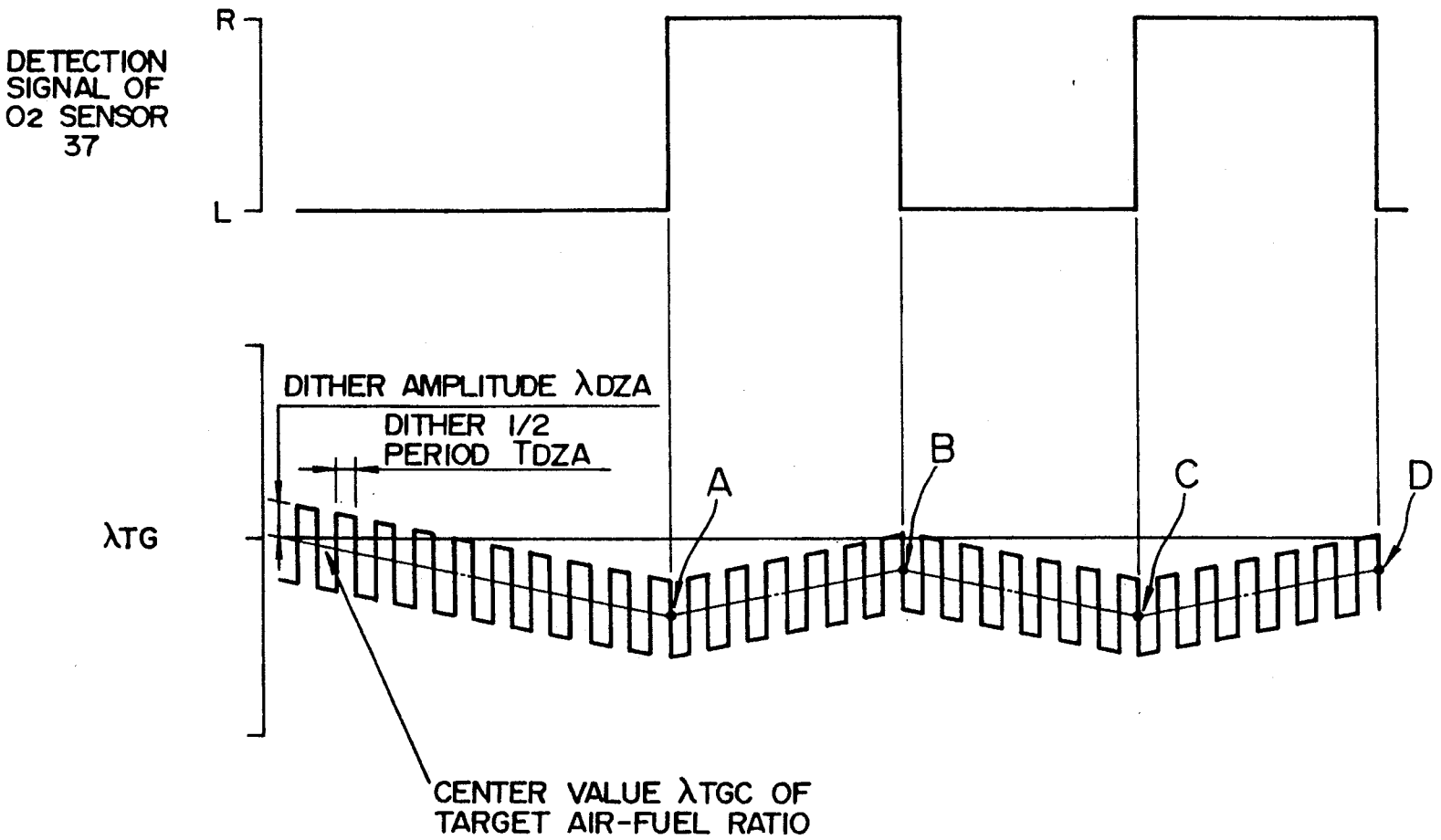

FIG. 9 shows a timing chart regarding the dither control. The target air-fuel ratio $\lambda_{TG}$ is changed and set to a value on the rich or lean side by only the dither amplitude $\lambda_{DZA}$ for the center value $\lambda_{TGC}$ at the short dither period $T_{DZA}$. Therefore, the purification factor $\eta$ of the 3-component catalytic converter 38 can be raised.

Figure 3:
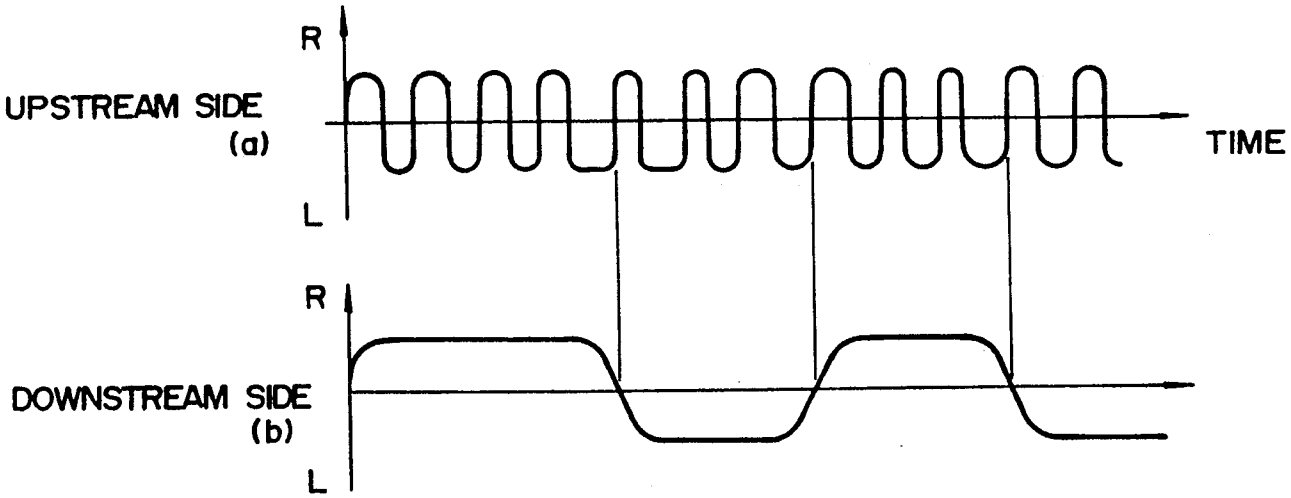
FIG. 3 is a characteristic diagram of a detection signal of an $O_2$ sensor.

The characteristics of the detection signal in the case where the $O_2$ sensor 37 is arranged on the downstream side of the 3-component catalytic converter 38 are shown in (b) in FIG. 3. As will be obviously understood from the characteristic diagram, according to the characteristics ((b) in FIG. 3) of the detection signal in the case where the $O_2$ sensor 37 is arranged on the downstream side of the 3-component catalytic converter 38, the rich/lean inverting period is longer than that in the characteristics ((a) in FIG. 3) of the detection signal in the case where the $O_2$ sensor 37 is arranged on the upstream side of the 3-component catalytic converter 38. This is because the harmful components in the exhaust gas are purified by the 3-component catalytic converter 38 by the oxidation-reduction reaction. Therefore, even if a control is executed so that the air-fuel ratio $\lambda$ is repetitively set to the rich and lean values at a short period in order to raise the purification factor $\eta$ of the 3-component catalytic converter 38, the air-fuel ratio sensor 36 can be accurately corrected without being influenced by such a control.

On the other hand, since the exhaust gas is sufficiently mixed on the downstream side of the 3-component catalytic converter 38, the detection signal of the air-fuel sensor 36 indicates the average air-fuel ratio $\lambda$ of all of the cylinders without depending on the air-fuel ratio $\lambda$ of the special cylinder. Consequently, the air-fuel ratio $\lambda$ can be properly corrected.

Further, since the exhaust gas is cooled by the 3-component catalytic converter 38 and the copper component in the exhaust gas is also absorbed, deterioration of the $O_2$ sensor 37 can be prevented.

In the above embodiment, the center value $\lambda_{TGC}$ of the target air-fuel ratio is always set in accordance with the detection signal of the $O_2$ sensor 37. Therefore, it is also possible to set the center value $\lambda_{TGC}$ of the target air-fuel ratio to a predetermined value at a time point when the time of the rich state of the detection signal of the $O_2$ sensor 37 and the time of the lean state are almost equal and to stop the setting of the center value after that. In this case, the center value $\lambda_{TGC}$ of the target air-fuel ratio can be set to a point D in FIG. 9 or to an average value of points A, B, C, and D.

On the other hand, in the above embodiment, the center value $\lambda_{TGC}$ of the target air-fuel ratio has been set in accordance with the detection signal of the $O_2$ sensor at each control timing. However, as another embodiment, the center value $\lambda_{TGC}$ of the target air-fuel ratio can be also set in accordance with the time of the rich state and the time of the lean state at a predetermined period of the detection signal of the $O_2$ sensor.

Another embodiment will now be described hereinbelow. As mentioned above, the target air-fuel ratio $\lambda_{TG}$ is set and controlled so as to repeat the rich/lean values at a short period. If the center value $\lambda_{TGC}$ of the target air-fuel ratio is equal to a stoichiometric air-fuel ratio $\lambda_0$ (14.7) ($\lambda_{TGC}=\lambda_0$), the detection signal of the $O_2$ sensor 37 is as shown in (a) in FIG. 10. That is, a total time $ST_R$ of times $T_{Ri}$ of the rich state at a predetermined period of the detection signal is equal to a total time $ST_L$ of times $T_{Li}$ of the lean state. That is, $$ST_R=ST_L$$

where, $$ST_R = \sum_{i=1}^{N} T_{Ri} = T_{R1} + T_{R2} + \ldots + T_{RN}$$

$$ST_L = \sum_{i=1}^{N} T_{Li} = T_{L1} + T_{L2} + \ldots + T_{LN}$$

Figure 10:
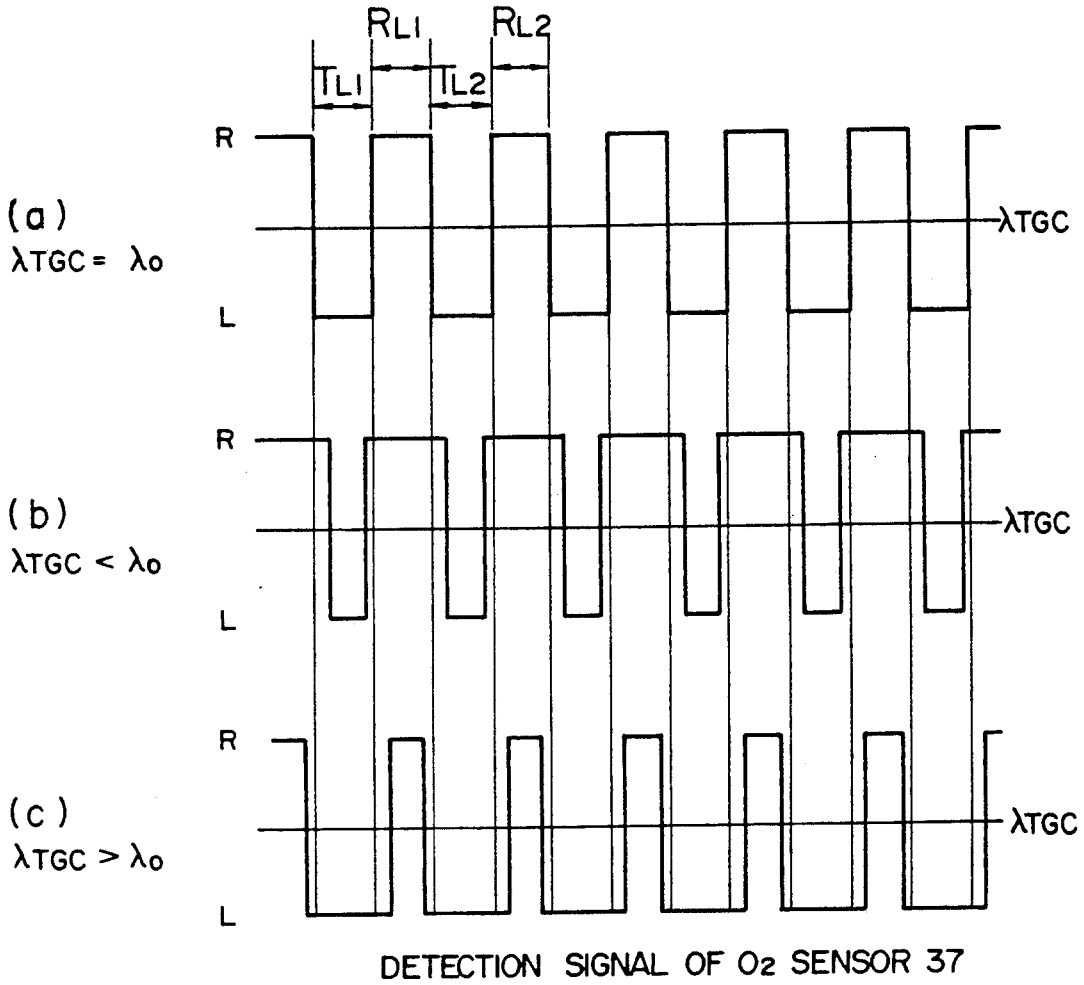
FIG. 10 is a timing chart of another embodiment.

On the other hand, if the center value $\lambda_{TGC}$ of the target air-fuel ratio is rich for the stoichiometric air-fuel ratio $\lambda_0$ ($\lambda_{TGC}<\lambda_0$), the times $T_{Ri}$ of the rich state are longer than the times $T_{Li}$ of the lean state as shown in (b) in FIG. 10. That is, $$ST_R>ST_L$$

On the other hand, if the center value $\lambda_{TGC}$ of the target air-fuel ratio is lean for the stoichiometric air-fuel ratio $\lambda_0$ ($\lambda_{TGC}>\lambda_0$), the times $T_{Li}$ of the lean state are longer than the times $T_{Ri}$ of the rich state as shown in (c) in FIG. 10. That is, $$ST_R<ST_L$$

Figure 11:
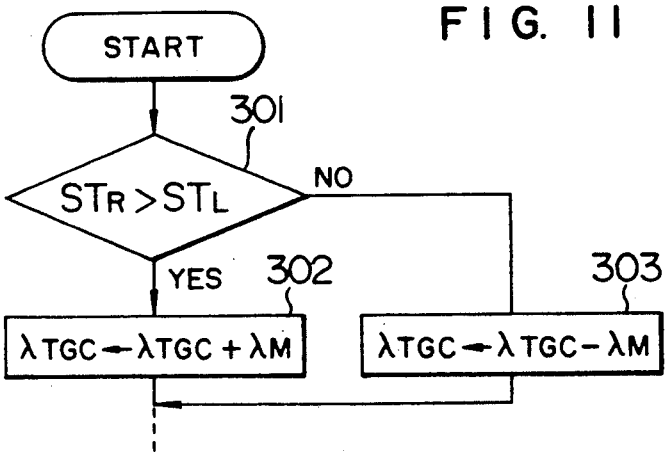
FIG. 11 is a flowchart for explaining the operation of another embodiment.

Explanation will now be made with reference to a flowchart shown in FIG. 11. FIG. 11 is substantially similar to FIG. 7 except that only steps 301 to 303 are provided in place of steps 201 to 203 in FIG. 7. Therefore, the descriptions of the similar processes are omitted here.

First, in step 301, the total time $ST_R$ of the times of the rich state and the total time $ST_L$ of the times of the lean state for a predetermined period (for example, five periods in the embodiment) of the detection signal of the $O_2$ sensor are compared. The total times $ST_R$ and $ST_L$ of the rich/lean states are obtained by a routine which is activated synchronously with the inversion of the detection signal from the $O_2$ sensor 37. That is, a period of time from the preceding activation to the present activation is calculated and the resultant time is added to the total time $ST_R$ or $ST_L$ in accordance with the result of discrimination regarding whether such a time relates to the rich time or the lean time, so that the total times $ST_R$ and $ST_L$ can be obtained. If $ST_R > ST_L$ in step 301, this means that the center value $\lambda_{TGC}$ is rich for the stoichiometric air-fuel ratio $\lambda_0$, so that the center value $\lambda_{TGC}$ is increased by only the predetermined value $\lambda_M$ ($\lambda_{TGC} \leftarrow \lambda_{TGC} + \lambda_M$) in step 302.

On the other hand, if $ST_R > ST_L$ in step 301, this means that the center value $\lambda_{TGC}$ of the target air-fuel ratio is lean for the stoichiometric air-fuel ratio. Therefore, the center value $\lambda_{TGC}$ of the target air-fuel ratio is reduced by only the predetermined value $\lambda_M$ in step 303 ($\lambda_{TGC} \leftarrow \lambda_{TGC} - \lambda_M$).

The setting of the center value $\lambda_{TGC}$ of the target air-fuel ratio is finished as mentioned above.

As described in detail above, according to the invention, the air-fuel ratio of the mixture gas is controlled so as to become a stoichiometric air-fuel ratio in accordance with the first detection signal which is output from the first oxygen concentration sensor arranged on the upstream side of the catalyst and the target air-fuel ratio. The target air-fuel ratio is set in accordance with the second detection signal which is output from the second oxygen concentration sensor arranged on the downstream side of the catalyst so as to correct a deviation between the actual air-fuel ratio and the first detection signal.

Therefore, there are excellent effects such that the deviation between the actual air-fuel ratio and the first detection signal can be accurately corrected and the air-fuel ratio can be accurately controlled to the air-fuel ratio of a high purification factor of the catalyst.

We claim:

1. An air-fuel ratio control apparatus for an engine, comprising:

a catalyst, arranged in an exhaust pipe of the engine, for purifying an exhaust gas;

a first oxygen concentration sensor, arranged in an exhaust pipe of an engine, for outputting a first linear detection signal for an air-fuel ratio of a mixture gas supplied to the engine;

a second oxygen concentration sensor, arranged on a downstream side of a catalyst to purify an exhaust gas which is exhausted from the engine, for outputting a second detection signal according to whether the air-fuel ratio is rich or lean for a stoichiometric air-fuel ratio;

target air-fuel ratio setting means for setting a target air-fuel ratio in accordance with the second detection signal; and fuel injection amount setting means for setting a fuel injection amount which is supplied to the engine in accordance with the first detection signal and the target air-fuel ratio.

2. An apparatus according to claim 1, wherein the target air-fuel ratio setting means comprises:

operating state detecting mean for detecting an operating state of the engine;

sub-target air-fuel ratio setting means for setting a target air-fuel ratio in accordance with the operating state; and target air-fuel ratio correcting means for correcting the target air-fuel ratio in accordance with the second detection signal.

3. An apparatus according to claim 2, wherein the sub-target air-fuel ratio setting means has target air-fuel ratio memory means for storing an air-fuel ratio at which a maximum purification factor of the catalyst is obtained as a target air-fuel ratio every said operating state.

4. An apparatus according to claim 2, wherein the target air-fuel ratio correcting means has first target air-fuel ratio correcting means for correcting in a manner such that the target air-fuel ratio gradually changes to a lean side by a predetermined amount at a time in the case where the second detection signal indicates a rich state and that the target air-fuel ratio gradually changes to a rich side by a predetermined amount at a time in the case where the second detection signal indicates a lean state.

5. An apparatus according to claim 2, wherein the target air-fuel ratio correcting means comprises:

total rich time detecting means for detecting a total rich time of the second detection signal in a predetermined period of time;

total lean time detecting means for detecting a total lean time of the second detection signal in the predetermined period of time; and second target air-fuel ratio correcting means for correcting in a manner such that the target air-fuel ratio gradually changes to a lean side by a predetermined amount at a time in the case where the total rich time is longer than the total lean time and that the target air-fuel ratio gradually changes to a rich side by a predetermined amount at a time in the case where the total lean time is longer than the total rich time.

6. An apparatus according to claim 2, wherein the target air-fuel ratio setting means has target air-fuel ratio resetting means for resetting a value which periodically changes with a predetermined amplitude with respect to the target air-fuel ratio which was corrected by the target air-fuel ratio correcting means as a center into the target air-fuel ratio.

7. An apparatus according to claim 6, wherein the target air-fuel ratio resetting means has predetermined amplitude memory means for storing the predetermined amplitude at which the maximum purification factor of the catalyst is obtained every said operating state.

8. An air-fuel ratio control apparatus for an engine, comprising:

a catalyst, arranged in an exhaust pipe of the engine, for purifying an exhaust gas;

a first oxygen concentration sensor, arranged in an exhaust pipe of an engine, for outputting a first linear detection signal for an air-fuel ratio of a mixture gas supplied to the engine;

a second oxygen concentration sensor, arranged on a downstream side of a catalyst to purify an exhaust gas which is exhausted from the engine, for outputting a second detection signal according to whether the air-fuel ratio is rich or lean for a stoichiometric air-fuel ratio;

operating state detecting means for detecting an operating state of the engine;

initial value setting means for setting an initial value of a target air-fuel ratio in accordance with the operating state;

target air-fuel ratio correcting means for correcting the target air-fuel ratio in accordance with the second detection signal every predetermined period; and fuel injection amount setting means for setting a fuel injection amount which is supplied to the engine in accordance with the first detection signal and the target air-fuel ratio.

9. An apparatus according to claim 8, wherein the initial value setting means has initial value memory means for storing an air-fuel ratio at which a maximum purification factor of the catalyst is obtained as an initial value every said operating state.

10. An apparatus according to claim 9, wherein the fuel injection amount setting means comprises:

fundamental fuel injection amount setting means for setting a fundamental fuel injection amount in accordance with the operating state; and air-fuel ratio correction amount setting means for setting an air-fuel ratio correction amount in accordance with the first detection signal and the target air-fuel ratio.

11. An apparatus according to claim 10, wherein the air-fuel ratio correction amount setting means comprises:

state variable amount detecting means for detecting a state variable amount in accordance with the first detection signal and the air-fuel ratio correction amount which was set at a past control timing;

integration value calculating means for calculating an integration value of a deviation between the first detection signal and the target air-fuel ratio; and air-fuel ratio correction amount calculating means for calculating the air-fuel ratio correction amount in accordance with the state variable amount and the integration value.

12. An apparatus according to claim 11, wherein the air-fuel ratio correction amount calculating means has constant memory means for storing an optimum feedback gain and an integration constant which have been preset so that the engine exhibits a desired operation on the basis of a dynamic model of the engine.

* * * * *